US010017303B2

(12) United States Patent
Wagner et al.

(10) Patent No.: US 10,017,303 B2
(45) Date of Patent: Jul. 10, 2018

(54) CHILD RESISTANT MEDICAL PACKAGE

(71) Applicant: Medcomb Holding APS, Copenhagen V (DK)

(72) Inventors: John Wagner, Vaerloese (DK); Flemming Wagner, Frederiksberg C (DK)

(73) Assignee: MEDCOMB HOLDING APS, Copenhagen V (DK)

( * ) Notice: Subject to any disclaimer, the term of this patent is extended or adjusted under 35 U.S.C. 154(b) by 368 days.

(21) Appl. No.: 14/442,348

(22) PCT Filed: Nov. 21, 2013

(86) PCT No.: PCT/DK2013/050395

§ 371 (c)(1),
(2) Date: May 12, 2015

(87) PCT Pub. No.: WO2014/079461

PCT Pub. Date: May 30, 2014

(65) Prior Publication Data

US 2016/0272382 A1 Sep. 22, 2016

Related U.S. Application Data

(60) Provisional application No. 61/729,101, filed on Nov. 21, 2012.

(30) Foreign Application Priority Data

Nov. 21, 2012 (DK) ..... 2012 70725

(51) Int. Cl.

| | |
|---|---|
| ***B65D 83/04*** | (2006.01) |
| ***B65D 50/04*** | (2006.01) |
| ***A61J 1/00*** | (2006.01) |

(52) U.S. Cl.
CPC ..... *B65D 50/046* (2013.01); *A61J 1/00* (2013.01); *B65D 2203/10* (2013.01);
(Continued)

(58) Field of Classification Search
CPC ..... B65D 50/046; B65D 2313/04; B65D 2215/06; B65D 2203/10; B65D 2215/08; A61J 1/00
(Continued)

(56) References Cited

U.S. PATENT DOCUMENTS 7,549,541 B2 * 6/2009 Brozell ..... B65D 83/0463 206/531
7,866,476 B2 * 1/2011 McGonagle ..... A61J 1/035 206/472
(Continued)

FOREIGN PATENT DOCUMENTS

FR 2 628 717 A1 9/1989
WO WO 2010/089562 A1 8/2010
(Continued)

OTHER PUBLICATIONS

International Search Report for PCT/DK2013/050395 dated Mar. 11, 2014.

*Primary Examiner* — Jacob K Ackun
*Assistant Examiner* — Jenine Pagan
(74) *Attorney, Agent, or Firm* — Knobbe, Martens, Olson & Bear, LLP

(57) ABSTRACT

The present invention relates to a medical package for enclosing pharmaceutical composition or medical devices, with at least three degrees of child protection means. The package cannot be crushed or perforated by a child, and is provided with opening means which physically hinder chil-
(Continued)

dren from opening the package. The opening means are counter-intuitive, so that reading instructions is necessary in order to open the package.

8 Claims, 17 Drawing Sheets

(52) U.S. Cl.
CPC ..... *B65D 2215/06* (2013.01); *B65D 2215/08* (2013.01); *B65D 2313/04* (2013.01)

(58) Field of Classification Search
USPC ..... 206/438, 531, 528, 534, 530, 535, 536, 206/538, 539, 818, 828, 1.5; 220/326, 220/324
See application file for complete search history.

(56) References Cited

U.S. PATENT DOCUMENTS 7,900,772 B2 * 3/2011 Sack ..... A61J 1/035 206/1.5
2002/0185404 A1 12/2002 Donegan
2004/0089668 A1 5/2004 Lambelet, Jr.
2004/0226853 A1 * 11/2004 Intini ..... B65D 43/162 206/536
2006/0081641 A1 4/2006 Habeger et al.
2007/0224379 A1 * 9/2007 Stevenson ..... B32B 15/08 428/40.1
2009/0045078 A1 * 2/2009 Gelardi ..... B65D 83/0463 206/1.5
2009/0127156 A1 * 5/2009 Tung ..... B65D 83/0463 206/531
2009/0184023 A1 7/2009 Brollier et al.
2009/0223994 A1 9/2009 Getz
2009/0255842 A1 * 10/2009 Brozell ..... B65D 83/0463 206/531
2010/0264054 A1 * 10/2010 Beecroft ..... B65D 83/0472 206/531
2011/0067363 A1 * 3/2011 Sprada ..... B65D 83/0463 53/492

FOREIGN PATENT DOCUMENTS

WO WO 2012/053964 A1 4/2012
WO WO 2012/107790 A1 8/2012

* cited by examiner

CHILD RESISTANT MEDICAL PACKAGE

CROSS REFERENCE TO RELATED APPLICATIONS

This application is a U.S. National Phase Application of PCT International Application Number PCT/DK2013/050395, filed on Nov. 21, 2013, designating the United States of America and published in the English language, which is an International Application of and claims the benefit of priority to Danish Patent Application No. PA 2012 70725, filed on Nov. 21, 2012, and U.S. Provisional Application No. 61/729,101, filed on Nov. 21, 2012. The disclosures of the above-referenced applications are hereby expressly incorporated by reference in their entireties.

FIELD OF THE INVENTION

The present invention relates to a child resistant medical package for enclosing pharmaceutical composition or for enclosing medical devices.

BACKGROUND OF THE INVENTION

Unit dose packaging is an attractive packaging format that is used for a variety of applications. Examples of dose packaging include the well known blister package or blister card, the most common use being to contain articles such as, tablets, pills, capsules and similar consumable items. Conventional blister packages generally include a blister pack that typically comprises a thermo-formed plastic sheet containing integrally formed blisters that are dimensioned to hold one or more articles. Articles are disposed within each blister and the plastic sheet is sealed to a backing sheet that normally comprises a foil, plastic film, or paperboard barrier. The backing sheet is applied to cover each blister and securely houses the articles therein. To release an item from a blister, the backing sheet is punctured or ruptured. However these packages can be used for containing and carrying medical compositions in the forms of pills or tablets.

These packages can also be easily used for containing and carrying medical devices such as syringes, catheters or insulin pens. The conventional blister packages provide removal of the items from the blisters, but offer no or very little child resistance.

It has been a practice of the drug industry particularly where childrens' medications are employed to make them more palatable so that children can be induced to take them. In this connection, aspirin, vitamins, anti-biotics and other medications are prepared to taste like candy so that a child will freely take them. If such drugs or medications are packaged in containers which are readily opened when accessible to children then the danger of a child accidently taking an overdose of the packaged contents exists if such a container is within the reach of a child and adequate safety precautions are not followed.

The problem of accidental ingestion of tablets contained in bottles or other packaging containers which can be easily opened by children is presently of huge concern in the international community.

Thus, child resistance is a feature that is particularly desired for unit dose pharmaceutical and medical device packaging.

One of the problems facing today's parents is keeping medication or pills beyond the reach of their children. Children do not have the ability to recognize the risk involved in consuming non-prescription medication.

Because of this fact there is an urgent need for a package from which pills are readily accessible to the adult, but not accessible to the child.

Press-through packs or "blister" packs are commonly used today to package units of medication or pills for oral ingestion. The press-through package is made up of a blister sheet, typically a clear, preformed polyvinyl chloride or polystyrene with flexible bubbles which form separate compartments or blisters for one or more pills; and a second rupturable backing sheet, like an aluminium foil or paper sheet, which has been attached to the blister sheet. The metal foil is attached by heat-sealing, solvent welding, gluing, or otherwise adhering the foil sheet to the blister sheet. A tablet is removed from a blister by pressing on the flexible blister which in turn forces the tablet against the foil, rupturing the foil, and ejecting the tablet.

It is sometimes desirable in making such a press-through package to include between the blister and backing sheets a rigid tray in which there are holes which coincide with the blisters in said blister sheet. The rigid tray is used to protect the pills from contamination and mechanical damage and may contain printed instructions as to the type of pill or the time a particular dosage is to be taken and with an indication of the dosage that has already been taken.

Measures taken to provide blister packages with child resistant features have generally included adding additional or thicker push-through films, applying stronger adhesion of peel films or tear-away strips, forming backings comprising heavier substrates. A downfall of the added safety features is that the blister package can be difficult to open by a user, is expensive and over packaged. For example, one result of added materials is that certain articles crumble when attempting to dispense the article from the reinforced backing sheet of the blister pack.

The recent trend in the packaging of medication has been to provide packages which will be safe, even if found by children. Most developments in the "child-resistant" line have been directed to the improvement in pill bottles. In this regard, safety caps have been devised which require a certain series of pushes and turns in order to open the bottle. However, there has been little development in the area of "child-resistant" press-type blister packages with which this invention is concerned.

All these so called safety packages have been found to be inadequate because where safety precautions are not taken a child could accidentally obtain sufficient quantities for an overdose.

In addition to a blister package being child resistant, it is desirable that the package permits easy withdrawal of items from the package by those intended to use the item stored therein such as an adult taking a prescription. As the blister packages are designed to be more resistant to tampering by a child, the elderly may have difficulty gaining access to the pharmaceutical dosage of medication within the package. This is especially important for users or patients whose manual dexterity and strength is reduced.

Accordingly, there remains in the art a need for a packaging system that is economical to manufacture and assemble, light weight, and provides child-resistant security features. There also remains a need for a packaging system that permits withdrawal of the item stored therein without the use of a tool, and with little manipulation of a user.

Hence, an improved medical package would be advantageous, and in particular a medical package with improved child safe features would be advantageous.

OBJECT OF THE INVENTION

A primary object of the present invention is to provide a child safe medical package for enclosing pharmaceutical composition or for enclosing medical devices.

Another object of the present invention is to provide a "child-resistant" medical package which can be easily opened by one who has been given instructions on how to do so, but cannot be opened by the uninstructed child.

It is also an object of the present invention to provide a child-resistant box which is easily opened by an adult but is intricate enough that it cannot be defeated through trial and error, and is difficult to defeat using simple tools or assistance of another child.

It is a further object of the present invention to provide an alternative to the prior art.

In particular, it may be seen as an object of the present invention to provide a child resistant medical package that solves the above mentioned problems of the prior art with several degree of child protection.

SUMMARY OF THE INVENTION

The invention is particularly, but not exclusively, advantageous for obtaining a child resistant medical package having a rigid structure.

Thus, the above described object and several other objects are intended to be obtained in a first aspect of the invention by providing a medical package comprising at least: a first portion for holding a carrier for pharmaceutical composition or medical devices; a second portion, wherein the first and the second portion are adapted to mutually engage upon folding and/or pressing of the second portion and the first portion onto each other, the second portion when engaged onto the first portion producing a rigid structure characterized by a high degree of bursting strength and/or compressive strength thereby providing a child resistant medical package that cannot be crushed or perforated by child handling.

Bursting strength is defined as the pressure at which the medical package will burst. Bursting strength provides a measure of resistance to rupture and depends largely on the tensile strength and extensibility of the material.

The medical package of the invention has a large tensile strength and extensibility. For example, the medical package may have a bursting strength between 1 and 1000 pounds per square inch (psi).

Compressive strength is the capacity of a material or structure to withstand axially directed pushing forces. Generally it is shown as a plot of force vs. deformation. Compressive strength provides an indication on the maximum load that can be applied to the medical package under specified conditions before it is crushed, and is generally expressed in psi.

For example, the medical package may have a compressive strength between 1 and 1000 psi.

The high degree of bursting strength and compressive strength may be provided by the mutual engagement of the first and second portion onto each other.

Child handling may be defined as normal handling by a child, e.g. exerting pressure on it by holding the medical package in the child hands.

Child is defined herein as an infant aged 42 to 51 months.

The package strength on its own may allow fulfilling the standards for child resistant package (CRP), such as ISO 8317.

The increased resistance to breakage of the medical package insures child safety as a child handling the medical package is not capable of disrupting the first and second portion and thus getting access to the medical compositions or medical devices therein contained.

The first portion for holding a carrier for pharmaceutical composition or medical devices may carry medical composition, such as pills or medical devices such as syringes, catheters or insulin pens.

A medical device may be an instrument, apparatus, implant, in vitro reagent, or similar or related article that is used to diagnose, prevent, or treat disease or other conditions, and does not achieve its purposes through chemical action within or on the body. Medical devices vary greatly in complexity and application. Examples range from tongue depressors, medical thermometers, and blood sugar meters to advanced devices such as microchip implants and prosthesis.

Medicinal compositions, also called pharmaceuticals or pharmaceutical compositions, achieve their principal action by pharmacological, metabolic or immunological means, while medical devices act by other means like physical, mechanical, or thermal means.

The rigid and stiff structure is thus provided by the mutual engagement of the two portions of the medical package.

By "mutual" is preferably meant that the first and second portion may have elements that engage one-by-one so that they do not necessarily all engage with any of the other elements of the respective portions. It is also covered by the scope of the present invention a medical package having one or more of the elements of the first portion that engage with more elements of the second portion.

Stiffness is defined as the resistance to deformation of an elastic body, i.e. the medical package resistance to deformation due to an applied force. For example, a desired degree of stiffness implies a resistance against deformation which allows for child handling and prevents undesired rupture of the second portion, of the medical package, of the pharmaceutical compositions or medical devices therein contained.

The medical package may be also referred to single use medical package as it may be a disposable medical package.

In some embodiments the first and second portion are made from a single sheet foldable into a folded configuration.

By single sheet is meant a continuous sheet of, e.g. plastic.

One of the advantages of the invention is that optimal mechanical handling of the package is achieved as both first and second portion are made from a single sheet. Thus folding of the single sheet provides engagement of the first and second portion onto each other so that the second portion having the function of a lid protects the first portion for holding a carrier for pharmaceutical composition or medical devices leading to a rigid structure.

In some embodiments the carrier for pharmaceutical composition or medical device is comprised in the medical package.

In some further embodiments the medical package comprises at least four sections made from a single sheet foldable into a folded configuration thereby producing a rigid structure, each section being pivotally connected to at least one of the other sections along fold lines in the single sheet, wherein at least two sections of said at least four sections are a first and a second carrier sections pivotally connected to each other, at least one of the first and second carrier section each comprising at least one cavity for housing pharmaceutical compositions, or the first and second carrier sections being adapted to mutually engage upon folding and/or pressing of the first and the second carrier sections onto each other, and wherein the other two sections are the first and second portions being foldable to adjacent to and at least partly covering the carrier sections when the sheet is folded so as to protect the carrier sections.

One of the advantages of this embodiment is that a single sheet may be used to produce the entire package comprising the carrier for pharmaceutical or medical devices.

In some further embodiments the first and second portion are made from separate sheets and comprise means for connecting the first and second portion to each other.

In an even further embodiments the first and second portion are hinged to each other.

The child-resistant medical package of the present invention may be produced by connecting two separate portions. For example, a first portion for holding a carrier for pharmaceutical composition or medical devices may be connected, e.g. hingedly connected to a second portion, such as a lid that can be closed on the first portion.

In some embodiments the first and second portion are pivotally connected to each other.

Pivotally is herein defined as connected in a pivotal manner, e.g. by means of or on a pivot so that it can be turned around along a pivot such as a specific point, axes or edge, e.g. a fold line.

In some embodiments the first and second portion comprise members that mutually engage upon folding and/or pressing of the first and the second portion onto each other.

Members may be protrusions or depressions having complementary shapes or dimensions. For example members may be buttons, latches, snibs or locks.

In some embodiments the mutual engagement comprises interlocking between the members.

The first and second portion, in these embodiments, may comprise members that once the first and the second portion are folded onto each other may preferably be joined by an interlocking mechanism.

In some further embodiments the mutual engagement comprises interference fit between the members.

The first and second portion, in these embodiments, may comprise members that once the first and the second portion are folded onto each other may preferably be joined by an interference fit mechanism.

The members of the medical package may be located on external or internal surfaces of the first and/or second portion.

The members may also be protrusions extending out of the external surface of the first portion and depressions on the external surface of the second portion.

The members may be apertures on a side surface of the first portion and protrusions on a side surface of the second portion.

In some embodiments correspondent apertures and protrusions may be located onto top and/or bottom surface of said first portion and/or said second portion.

In some other embodiments the members are hollow protrusions on the first portion, the hollow protrusions extending out of the side surface of the first portion, and hollow spaces on the second portion the hollow protrusions and hollow spaces adapted to mutually engage upon folding and/or pressing of the first and the second portion onto each other.

In some further embodiments correspondent hollow protrusions and hollow spaces may be located onto top and/or bottom surface of said first portion and/or said second portion.

The first and second portion may have members having complementary shapes so that members on the first portion are adapted to engage in an interference fit with members on the second portion when the first and the second portion are folded onto each other.

In some embodiments at least the first portion has a rim, the rim protruding out of the first portion, the rim being located at least partially around an internal peripheral edge of the first portion thereby when folded the rim is press fit with at least part of a side wall of the second portion.

In some other embodiments the medical package has a rim located on the internal surface of the first portion which by being in press fit contact with the internal surface of the side wall of the second portion allow for optimal handling and provides a high degree of bursting strength and/or compressive strength. The press fit contact between the rim and at least a section of the side walls of the second portion provides the outside surface of the package with a plane and stiff surface. The rigidity or stiffness of the package is increased by the press fit contact of the rim to the internal surface of the side wall of the second package when the medical package is folded. Therefore, a more robust and safe surface of the medical package is achieved through the support of the rim.

In some embodiments the rim on the first portion may comprise the members which mutually engage with members on the side walls of the second portion upon folding and/or pressing of the first and the second portion onto each other.

The medical package of the invention may further comprise gripping elements.

The gripping elements have the function of providing a better grip to the user of the medical package. Form, size and shape of the gripping elements are linked to their function. The gripping element may have any form and size which allows for human or mechanical gripping. The gripping elements shape may be of any geometrical form or combination of forms, e.g. triangular, circular or square. In some embodiments the gripping elements may have a user friendly shape, e.g. resembling a pad so as to provide a better user hold upon use. In some embodiments the gripping element may be made of non-slippery material, such as rubber or may have a certain degrees of surface roughness so as to provide a better grip. The gripping elements may be placed in different locations along the edges of the medical package.

In some embodiments according to the first aspect of the invention the medical package further comprises opening means that physically hinder children from opening the medical package.

The above described object and several other objects are intended to be obtained in a second aspect of the invention by providing a medical package comprising opening means that physically hinder children from opening the medical package.

A child is not able to open the medical package of the invention as the correct opening is physically hampered and/or impeded to a child as the child cannot hold the package in his hands and at the same time perform an action on the opening means. Thus, the child resistant medical package of the invention is characterized in that it cannot be hold and/or opened by child hands.

Physically hinder thus refers to the fact that the opening is hindered in relation to physical issues, e.g. in relation to body issues, such as the child hands dimensions.

The presence of child resistant opening means on its own may allow fulfilling the standards CRP, such as ISO 8317.

In some embodiments the means for opening the medical package are located at a distance from each other longer than the length between the thumb and one of the four fingers of a child hand when the child hand is open.

For example the distance between the opening means of the package may be in the range between 5 and 30 cm, more preferably in the range between 10 and 25 cm.

In some further embodiments the means for opening are at least two. The distance between the two opening means is thus longer than the length between the thumb and one of the four fingers of a child hand when opened.

In some embodiments the means for opening may be at least three located on different side and/or top and/or bottom surface of the medical package.

In some embodiments the means for opening may be apertures on a side surface of the second portion and protrusions on a side surface of the first portion.

In some embodiments correspondent apertures and protrusions may be located onto top and/or bottom surface of the second portion and/or the first portion.

The means for opening may comprise pressure means.

For example the pressure means may be buttons, latches, snibs or locks.

Thus, in order to open the package the user has to apply pressure onto at least two opposite positions of the medical package. This is achieved by holding the package on the palm and by using a finger and the opposed thumb to exert pressure onto two opposite positions located on opposite sides of the medical package. The pressure may be exerted in positions that are the most distant from each other.

These positions may be also located on the top or bottom surfaces of the medical package. Thus, those positions may be the pressure means. In some embodiments the pressure means are located on those positions.

In some further embodiments those positions or pressure means may be indicated by the presence of gripping elements. Thus, the gripping elements may hide the positions or pressure means. In some embodiments the positions or pressure means on which the user has to apply pressure so as to open the medical package may be located within a certain distance from the gripping elements or from further gripping elements.

This may have the advantage of misleading eventual attempt to open the medical package as the child may be tempted to grip the package via the gripping elements causing intentional or unintentional pressure on the gripping elements and not on the pressure means. By locating the pressure means in areas not identified by any gripping element located onto the external surface of the medical package, the positions on which pressure should be exert in order to open the medical package are de facto hidden and thus cannot be found unless the user is instructed to do so. In some embodiments the presence of more gripping elements may also mislead eventual attempt to open the medical package.

In some embodiments the pressure means comprise at least one first element on the first portion and at least one second element on the second portion having structures having complementary curvatures so that at least one first element on the first portion is adapted to mutually engage with at least one second element on the second portion when the first and second portion are folded onto each other.

Curvature refers intuitively to the amount by which a geometric object deviates from being flat.

In some embodiments the at least one first element on said first portion has a distal end having an external diameter which is complementary to a proximal end of the at least one second element on the second portion.

The at least one first element on the first portion may have a proximal end having an external diameter which is complementary to a distal end of the at least one second element on the second portion.

The proximal ends of the at least one first element on the first portion and the at least one second element on the second portion may have a shape engaging with corresponding terminal ends of the at least one first element on the first portion and the at least one second element on the second portion so as to interlock.

In some embodiments the means for opening comprise magnetic locking means.

The means for opening may comprise at least two magnets or magnetic materials which will snap together upon overlapping of the first and second portions of the medical package.

In some embodiments the means for opening are a key lock system where the lock is a first magnet located on the package and the key is a second magnet provided separated from the package.

In some further embodiments the means of opening comprises digital means for opening the package.

Examples of digital means may be printed electronics circuit allowing for finger print recognition, thus a biorecognition, of the user.

In some other embodiments digital means may be triggered by remote opening of the package upon signals from a computer or a portal digital assistant, e.g. a smart phone.

Digital opening means may be advantageous as capable of monitoring when a pill or a device is taken out of its packaging.

In some embodiments integration of Radio-frequency identification (RFID) tags, printed electronics circuit and/or ultra-low-power processor into the plastic foil used for construction of the medical package may provide advantageous digital opening means.

Magnetic locking means and digital means may also control the engagement and disengagement of the members comprised in the first and second portion of the medical package.

In some embodiments the opening means are not intuitive or are counter intuitive, thereby the opening of the medical package is achievable only upon reading opening instructions.

The above described object and several other objects are intended to be obtained in a third aspect of the invention by providing a medical package further comprising opening means, wherein the opening means are not intuitive or are counter intuitive, thereby the opening of the medical package is achievable only upon reading opening instructions.

Opening means are not intuitive or are counter intuitive, thus it cannot be understood simply by the appearance of the package the way in which it can be opened.

The presence of counter intuitive opening means on its own may allow fulfilling the standards CRP, such as ISO 8317.

This invention was also developed to provide a medical package that can be opened by an instructed adult who may have no more strength than the average child. The child who is uninstructed on the opening of the disclosed package will not be able to reach the package contents. The present invention, therefore, may also rely on the superior knowledge of the adult rather than his superior strength.

The opening instructions may be comprised on the external surface of the medical package.

In some embodiments these opening instructions may be printed, embossed, carved, stamped, etched or attached through an adhesive on the external surface of the first or second portion of the medical package.

The medical package of the invention may be characterized by the presence of at least three degree of child protection means.

The above described object and several other objects are intended to be obtained in a forth aspect by providing a medical package characterized by the presence of at least three degree of child protection means.

The first degree of child safety may be identified in the high degree of bursting strength and/or compressive strength of the medical package according to the first aspect of the invention. This may be referred to also as mechanical child safety.

The second degree of child safety may be identified in the presence of opening means leading to an opening system that physically hinders children from opening the medical package according to the second aspect of the invention. Thereby the opening of the medical package is physically impaired to a child, i.e. a child would not be able to open the medical package of the invention. The correct opening is hampered and/or impeded to a child as the child cannot hold the package in its hands and at the same time press the opening means.

The third degree of child safety may be identified in the fact that the opening means are not intuitive or are counter intuitive according to the third aspect of the invention.

The opening of said medical package is achievable only upon reading opening instructions thus only a child being able to read instructions is able to understand how to open the medical package.

A further degree of child safety may be identified in the presence of digital opening means allowing for opening of the medical package only upon a signal induced by electronic circuits triggered by either a bio signal of the user or by remote signals from an electronic device.

In a fifth aspect the invention further relates to a method of opening a medical package comprising at least two opening elements:

holding the medical package;

exerting a desired degree of pressure to the at least two opening elements.

The at least two opening elements are also referred herein as opening means or pressure means.

In some embodiments the at least two opening elements are more opening elements, allowing for opening upon application of pressure onto the opening elements simultaneously. The opening elements may be located on opposite sides of the medical package. The opening elements may be identified by determined positions onto the medical package.

In some embodiments the medical package may have a cube shape.

In some other embodiments the medical package may have a parallelepiped shape and the opposite sides are the longest opposite side.

The opening elements may be located on opposite positions that are located on the surface or on the sides of the first and/or second portion that are the most distant from each other.

In some embodiments the at least two opening elements are located on shortest and opposite sides of the medical package.

In some other embodiments the at least two opening elements are located on longest and opposite sides of the medical package.

The first, second and third and other aspects and embodiments of the present invention may each be combined with any of the other aspects and embodiments. These and other aspects and embodiments of the invention will be apparent from and elucidated with reference to the embodiments described hereinafter.

BRIEF DESCRIPTION OF THE FIGURES

The medical package according to the invention will now be described in more detail with regard to the accompanying figures. The figures show one way of implementing the present invention and is not to be construed as being limiting to other possible embodiments falling within the scope of the attached claim set.

DETAILED DESCRIPTION OF EMBODIMENTS

The present invention provides a child-resistant box for storage of medicine and similar products or medical devices such as insulin pens, which is readily opened by an adult but is inaccessible to a child.

Figure 1:
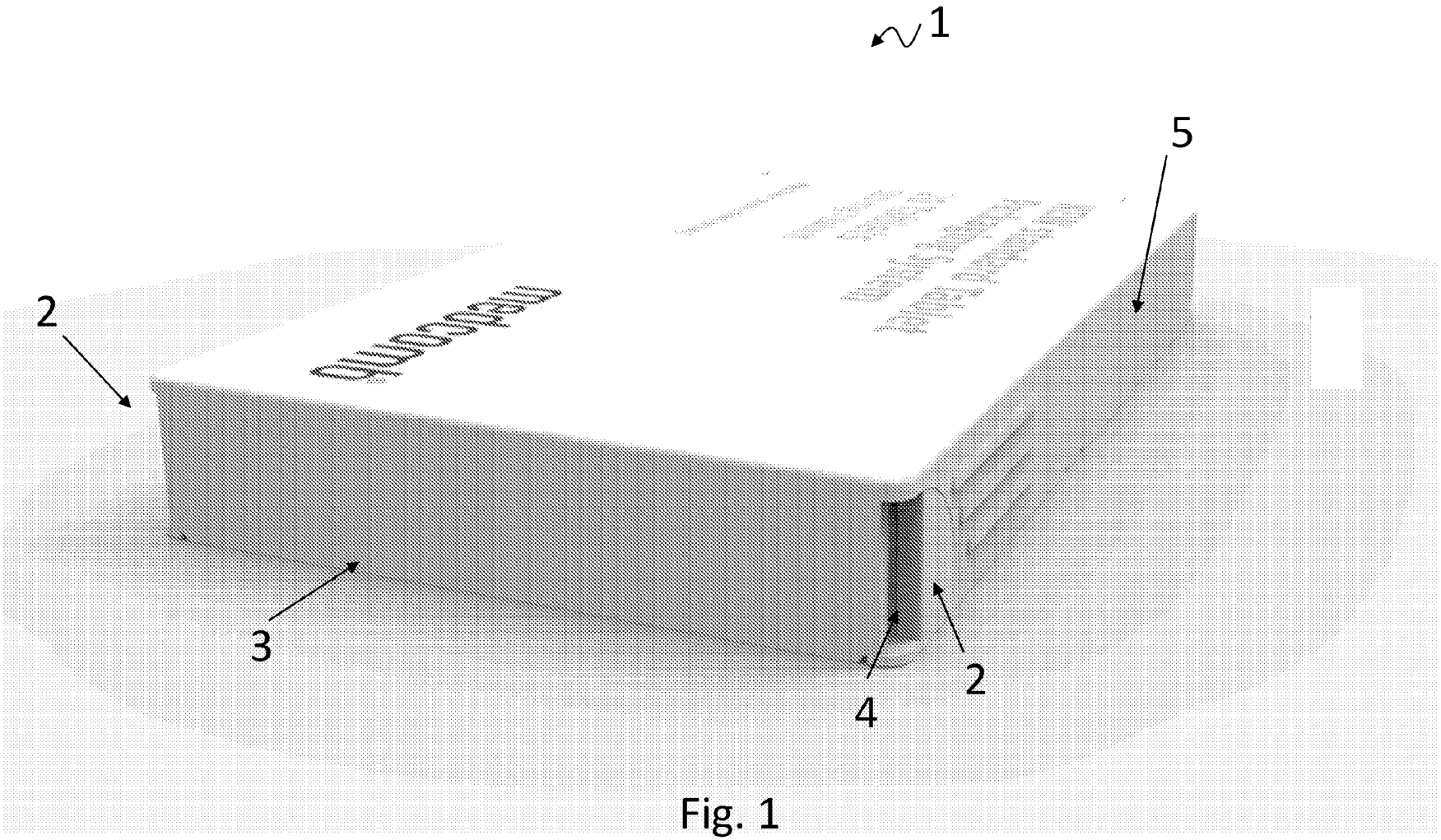
FIGS. 1 and 2 show schematically 3-dimensional views of a medical package in its folded or closed state having two means for opening located on the longest and opposite sides of the medical package according to one embodiment of the invention.
Figure 2:
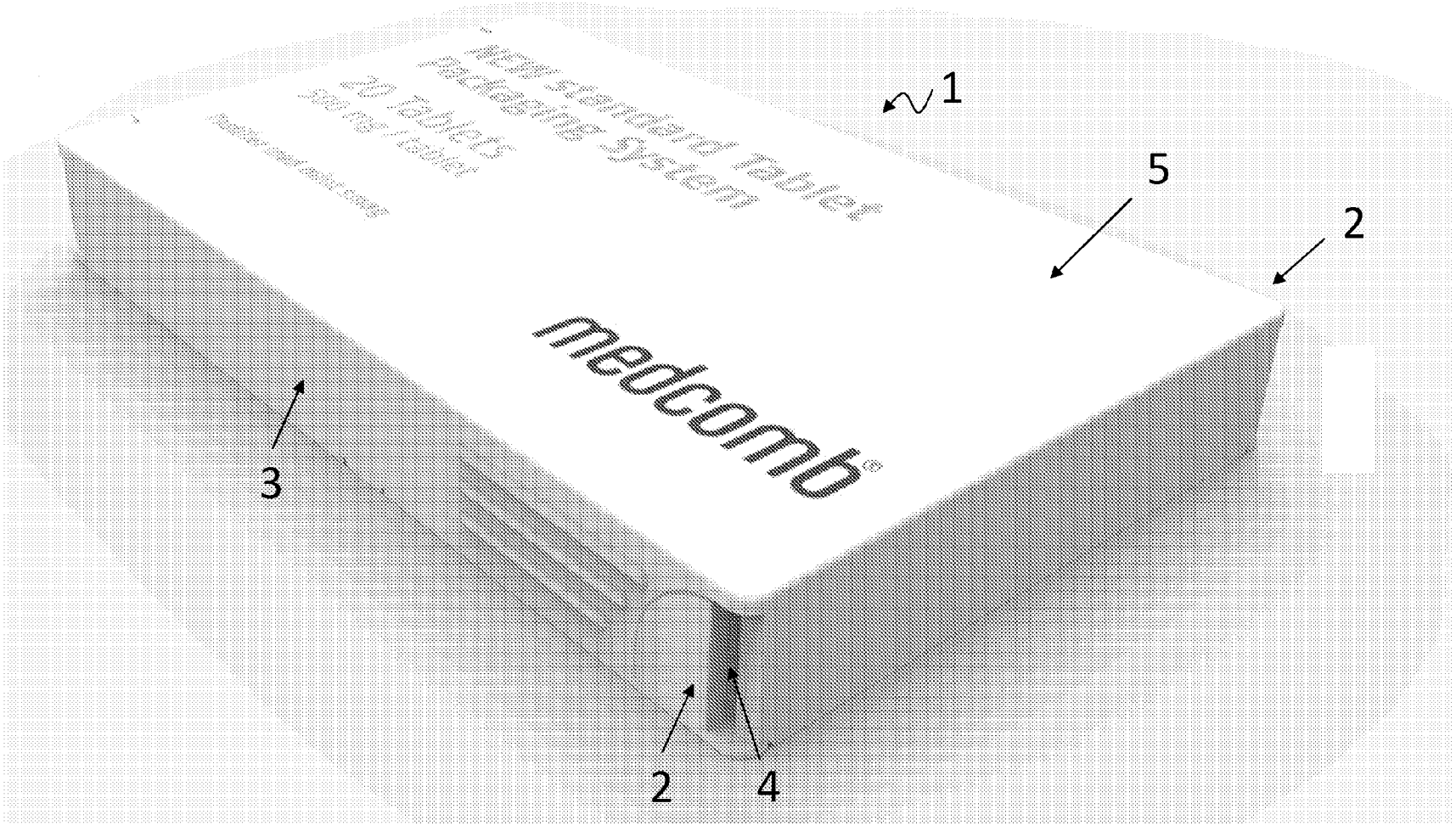

FIGS. 1 and 2 show schematically 3-dimensional views of a medical package in its folded or closed state having two means for opening located on the longest and opposite sides of the medical package according to one embodiment of the invention.

The child resistant medical package 1 has means for opening comprising at least two opening elements 2 on opposite sides of the first portion 3 of the medical package, which are complementary to apertures 4 on correspondent opposite sides of the second portion 5 of the medical package 1. These opening elements 2 when pressed, e.g. by an adult hand squeezing the two elements simultaneously, distort the first portion 3 and therefore allowing for the release of two hidden latches 6 and 7 (shown in FIG. 3), leading to the opening of the medical package as shown in FIG. 3.

The hidden latches 6 and 7 may have the shape of flaps on the second portion or lid 5, which are lowered into grooves on the first portion or carrier 3 and fit under the side wall 40 of the lid 5, holding the medical package 1 shut. Once the opening elements 2 are squeezed, such as pressed inwards through apertures 4 arranged in pairs around the corners of the lid 5, the first portion 3 is distorted and the latches 6 and 7 are released. The spacing between the apertures 4 corresponds to the distance between a finger and the thumb of an adult.

Figure 3:
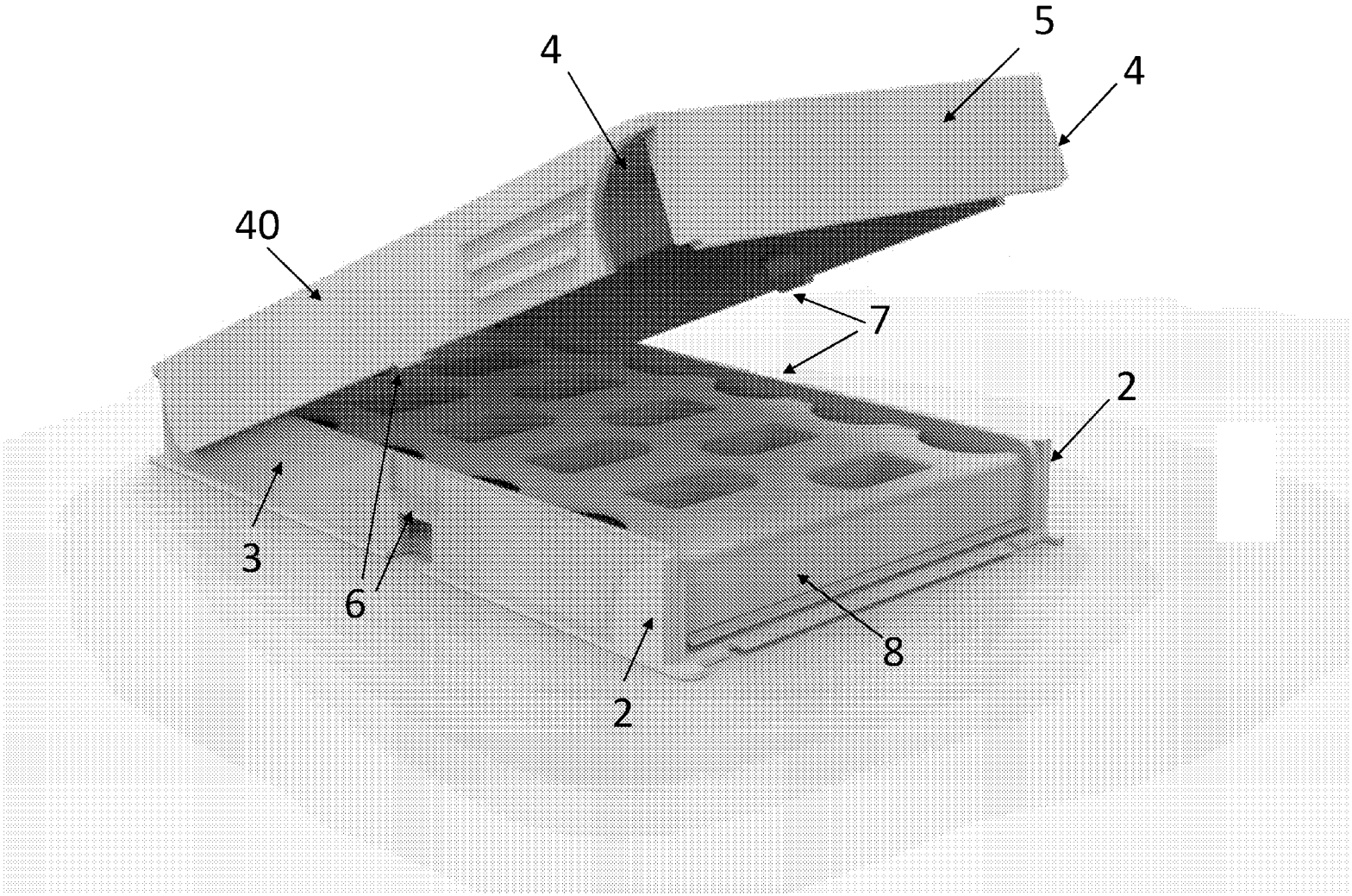
FIG. 3 shows schematically a 3-dimensional view of a medical package in its half-opened state according to some embodiments of the invention.

In some embodiments, as shown in FIG. 3, the medical package may comprise a blister package 8 held by the first portion 3 and contained inside the medical package 1. The medical package comprising the blister package may be formed by folding a single sheet according to some embodiments of the invention.

The medical package may also not comprise a blister package or a carrier for pharmaceutical compositions or medical devices.

Figure 4:
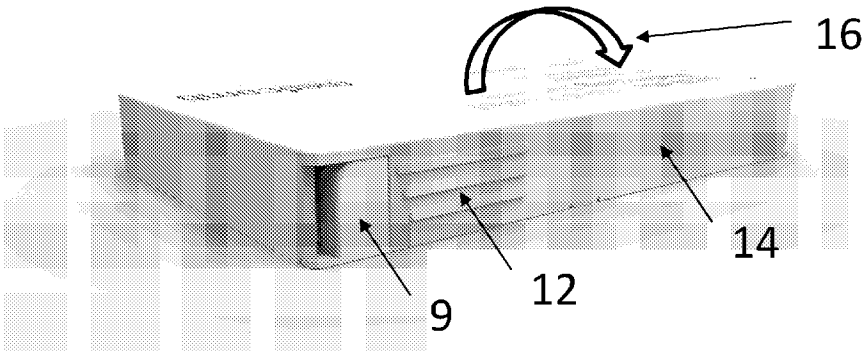
FIGS. 4, 5 and 6 show schematically 3-dimensional views of a medical package in its closed state where the two means for opening have different shapes according to some embodiments of the invention.
Figure 5:
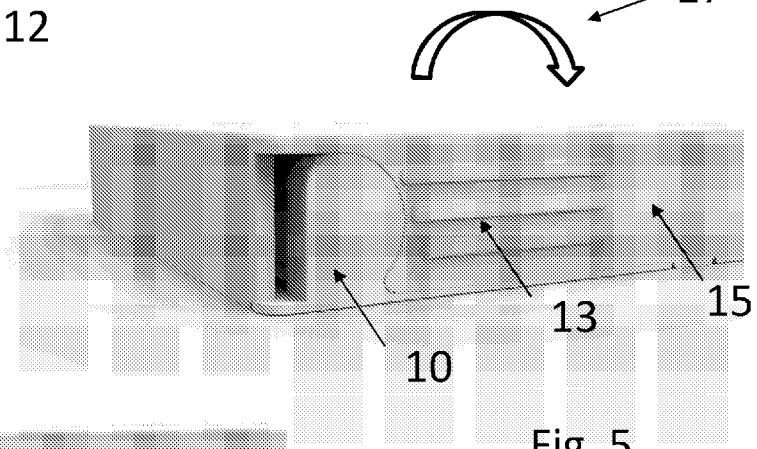
Figure 6:
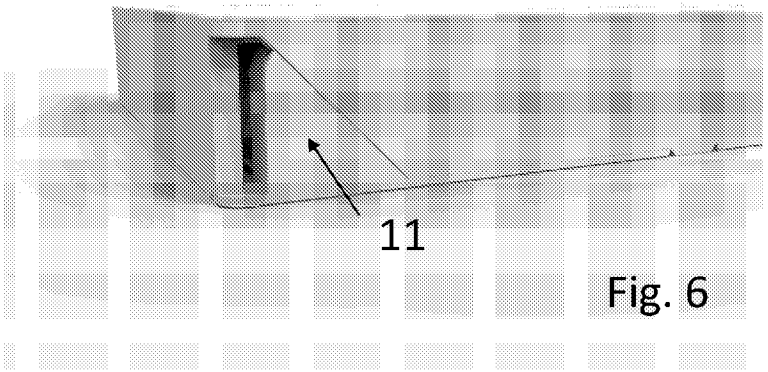

FIGS. 4, 5 and 6 show schematically 3-dimensional views of a medical package in its closed state where the means for opening have different shapes according to some embodiments of the invention.

Particular shapes of opening elements 9, 10 and 11 may have the advantage of being misleading towards the correct opening of the package for a child. Indeed the latches 6 and 7 are not visible thus it is not intuitive to determine that the opening of the medical package may be achieved by exerting pressure on the elements 9, 10 and 11.

FIGS. 4 and 5 show also the presence of pairs of gripping elements 12 and 13 located on opposite sides of the medical package in correspondence to opening elements 9 and 10. Gripping elements 12 and 13 may be used to grip the lid 14 and 15 so as to open the package following arrows 16 and 17. In order to open the package an adult hand thus has to squeeze simultaneously the pairs of opening elements 9 or 10 so as to release the hidden latches hidden under the lid 14 or 15. At the same time by holding the lids 14 or 15 an adult hand may open the package by gripping the pairs of gripping elements 12 or 13 and pull following arrows 16 or 17 so as to achieve an opening as shown in FIG. 3.

Figure 7:
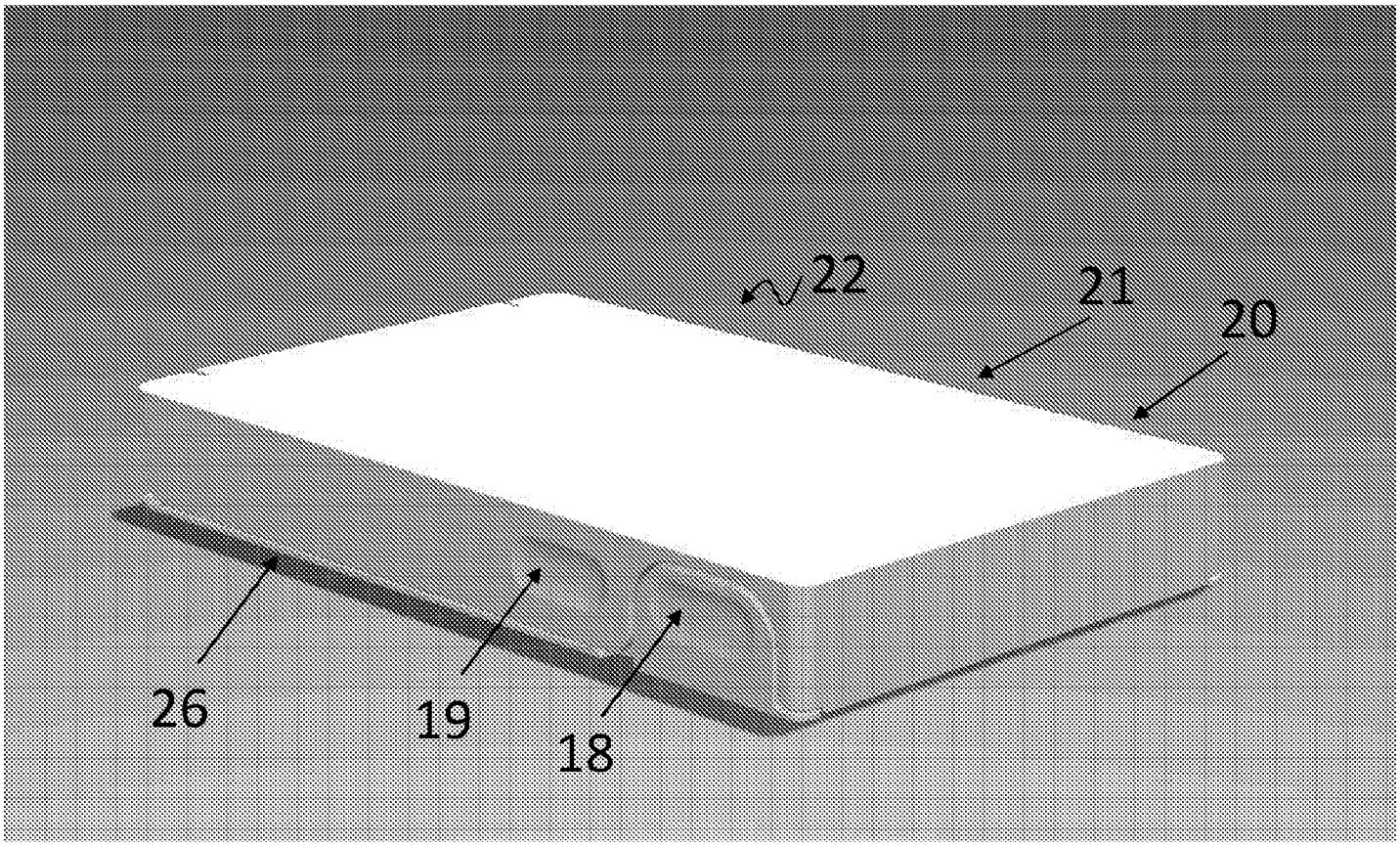
FIGS. 7, 8 and 9 show schematically 3-dimensional views of a medical package in its closed and opened state showing the locking mechanism according to some embodiments of the invention.

FIG. 7, show schematically a 3-dimensional view of a medical package in its closed state where two pairs of gripping elements 18, 19 and 20,21 are shown locate on the longest and opposite side of the medical package 22.

The pairs 20, 21 cannot be seen due to the orientation of the 3-dimensional view, however they resemble the pair 18, 19.

Figure 8:
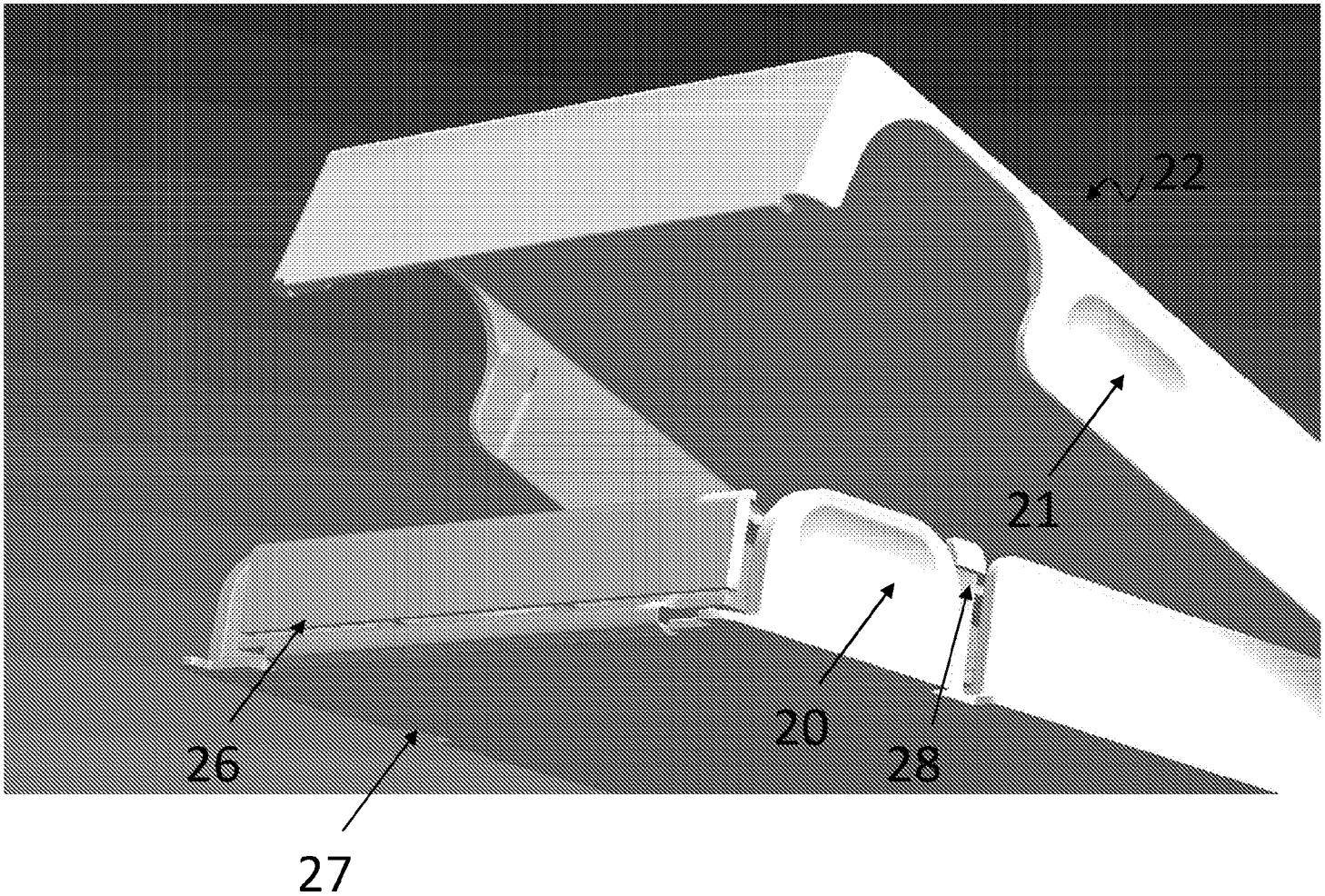
Figure 9:
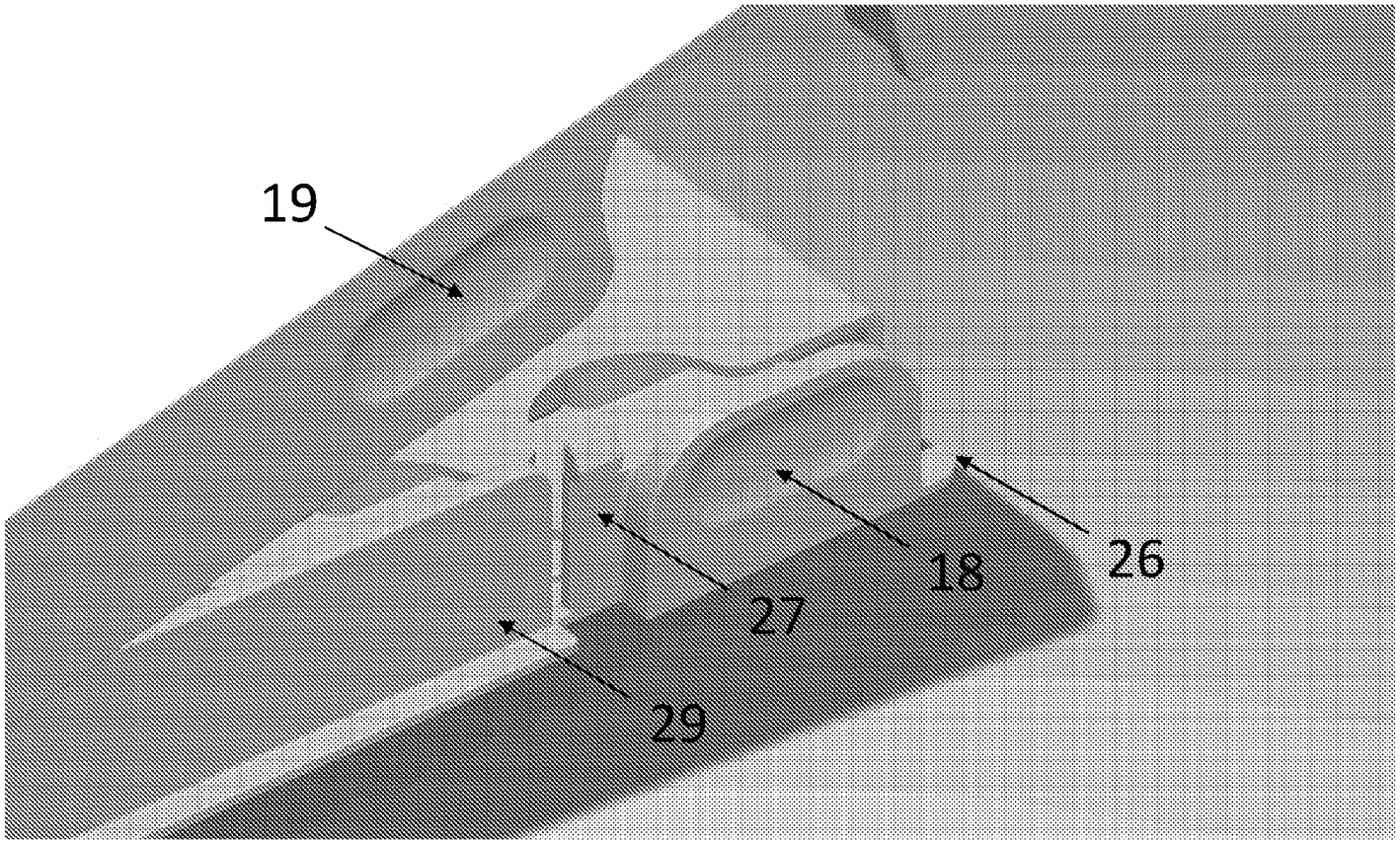

However, even if resembling each other, the two gripping elements of the pairs 18, 19 and 20, 21 have different functions. Gripping element 18 and 20 are opening elements. In order to open the medical package 22 and adult hand has to apply pressure on both opening elements 18 and 20 so as to distort the first portion 26 allowing the hidden latches 27 and 28 to be released. Hidden latches 27 and 28 may be located underneath the opening elements 18 and 20, therefore applying pressure on the opening elements 18 and 20 may allow the release latches 27 and 28 without distortion in the structure of the portion 26. In order to complete the opening following the release of the hidden latches 27 and 28, an adult hand should grip the gripping elements 19 and 21 so as to open the medical package 22 as shown in FIGS. 8 and 9. The opening elements 18 and 20 may comprise the latches 27 and 28 as shown in FIG. 9. Thus, opening may also be achieved by minimum distortion of the structure of the opening elements 18 and 20. The opening elements 18 and 20 may be comprised in the rim 29 of the carrier portion 26.

The shape and/or appearance of the pairs of gripping elements 18, 19 and 20, 21 is advantageously the same. If not instructed, a user, or a child approaching the medical package would not be able to distinguish the different functions of the gripping elements as they have the same appearance. A child thus may be tempted to grip all the elements thus hindering the release of the hidden latches.

Figure 10:
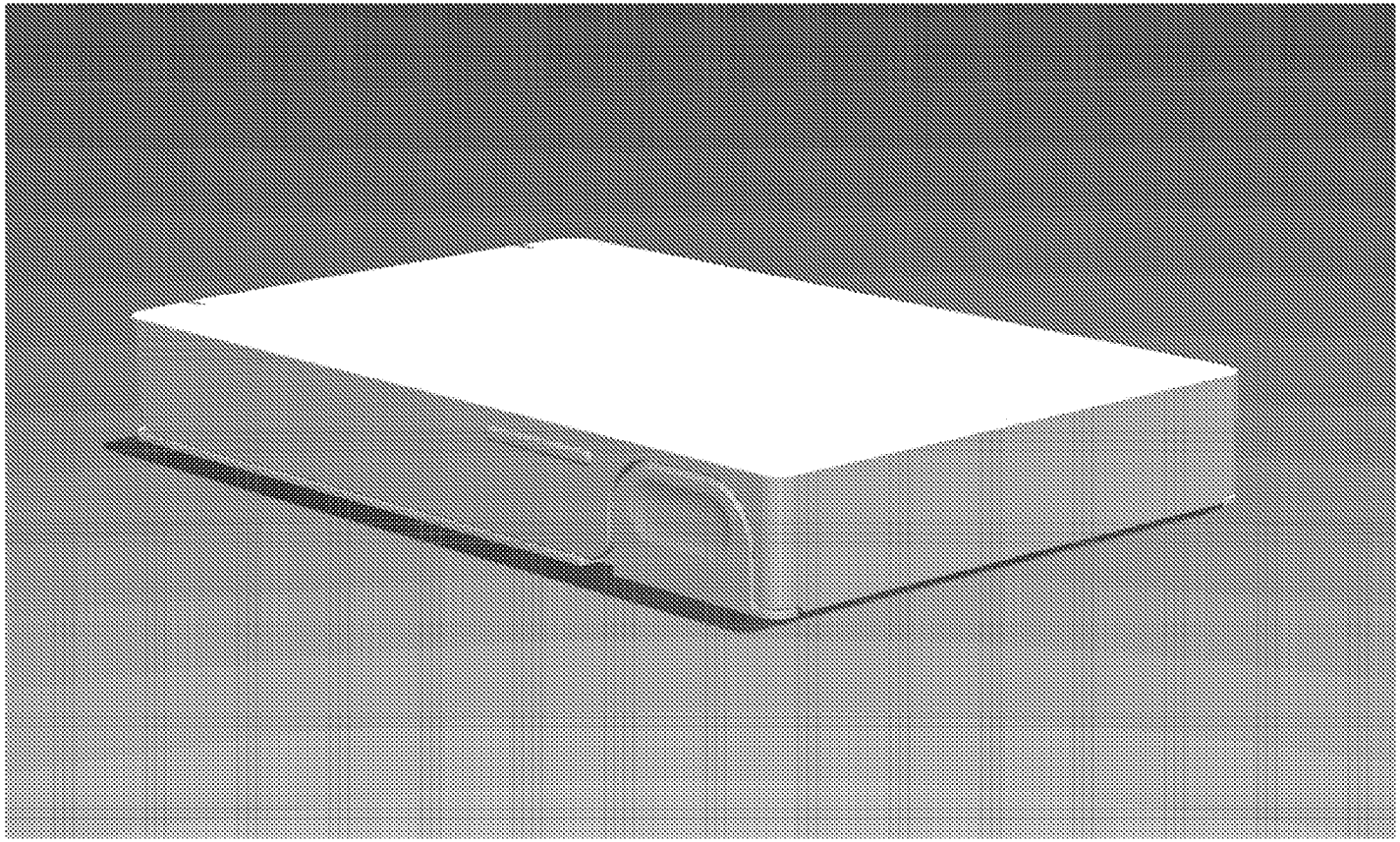
FIGS. 10 and 11 show schematically 3-dimensional views of a medical package in its closed state where further gripping elements are not present a part from the one on the opening elements, FIG. 11, or the pair of gripping elements have different shapes, FIG. 10, according to some embodiments of the invention.
Figure 11:
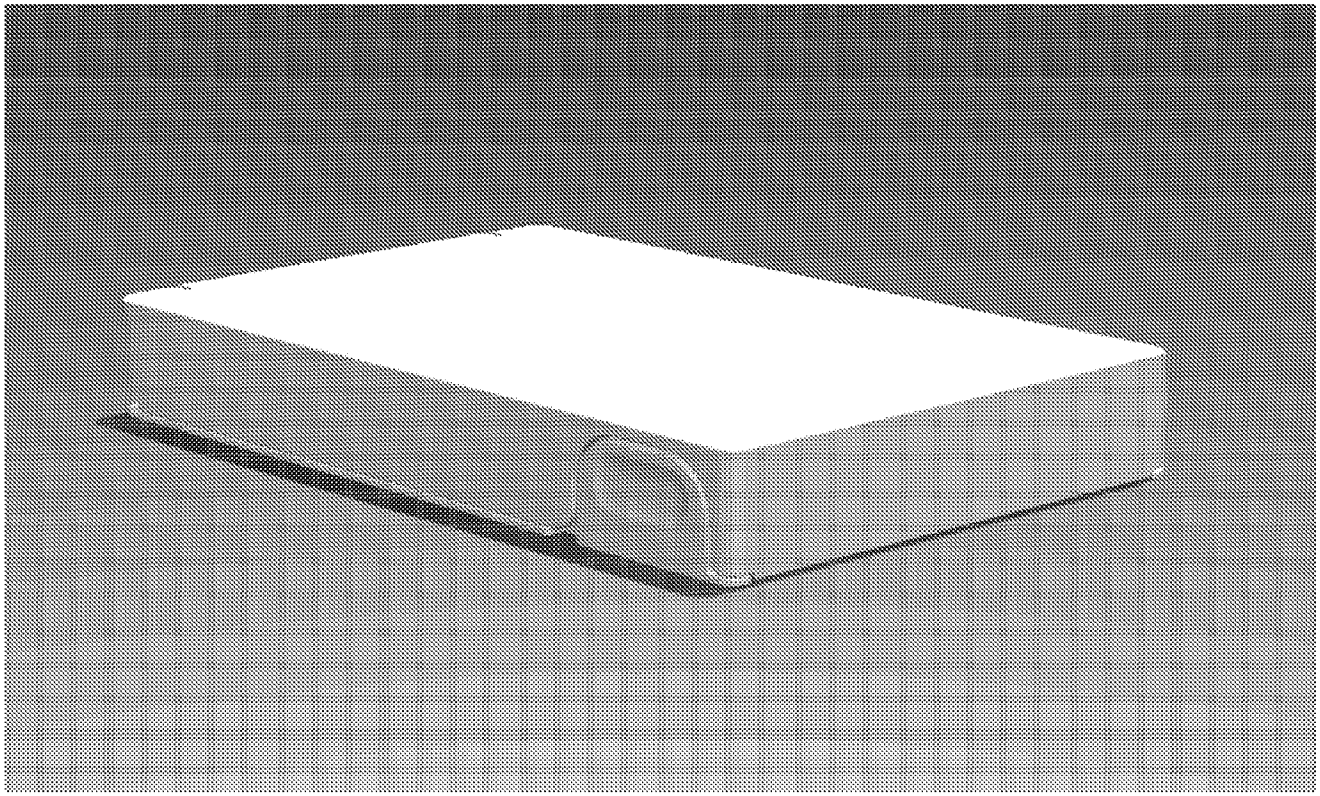

FIGS. 10 and 11 show schematically 3-dimensional views of a medical package in its closed state where further gripping elements are not present a part from the one on the opening elements, FIG. 11, or the pair of gripping elements have different shapes, FIG. 10, according to some embodiments of the invention.

Figure 12:
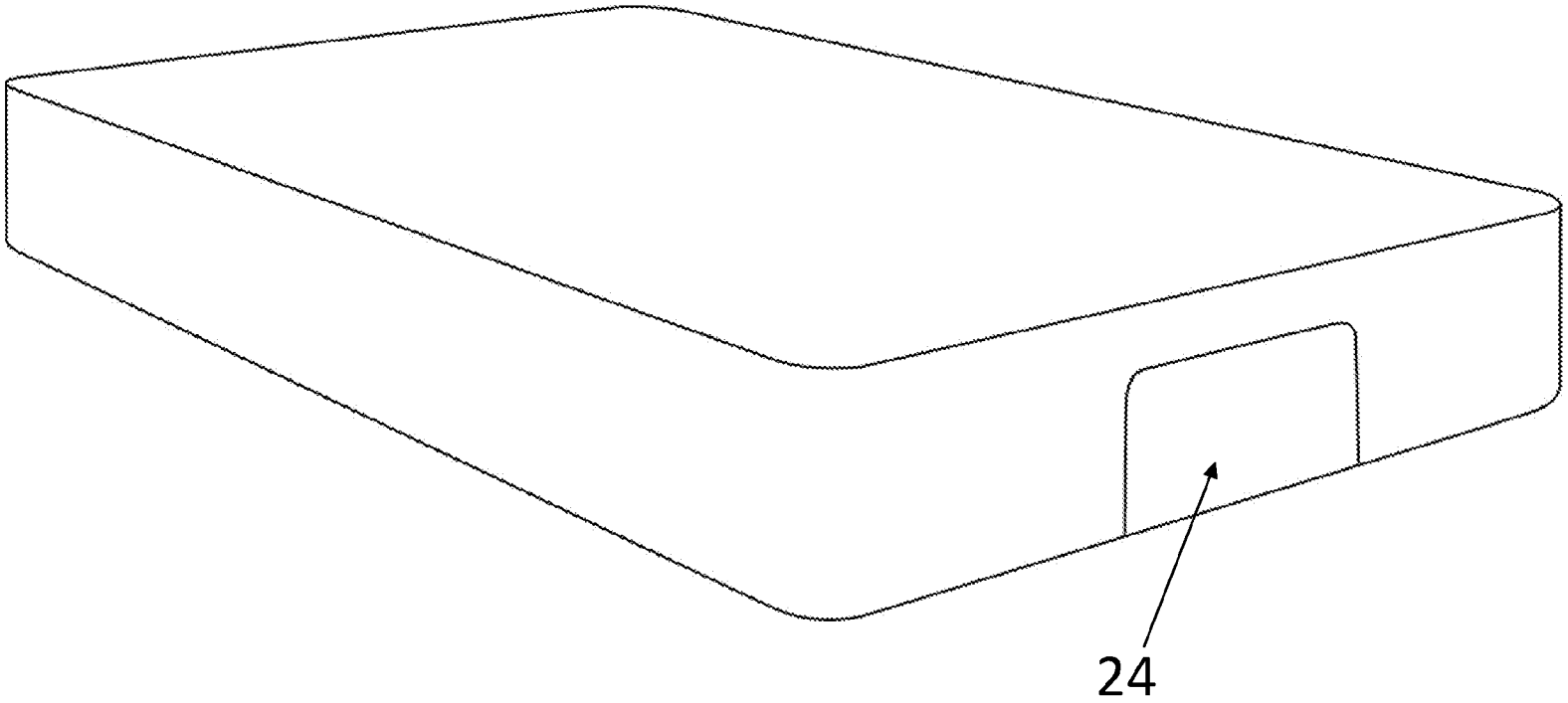
FIGS. 12 and 13 show schematically 3-dimensional views of a medical package in its closed state having two means for opening located on the shortest and opposite sides of the medical package according to one embodiment of the invention.
Figure 13:
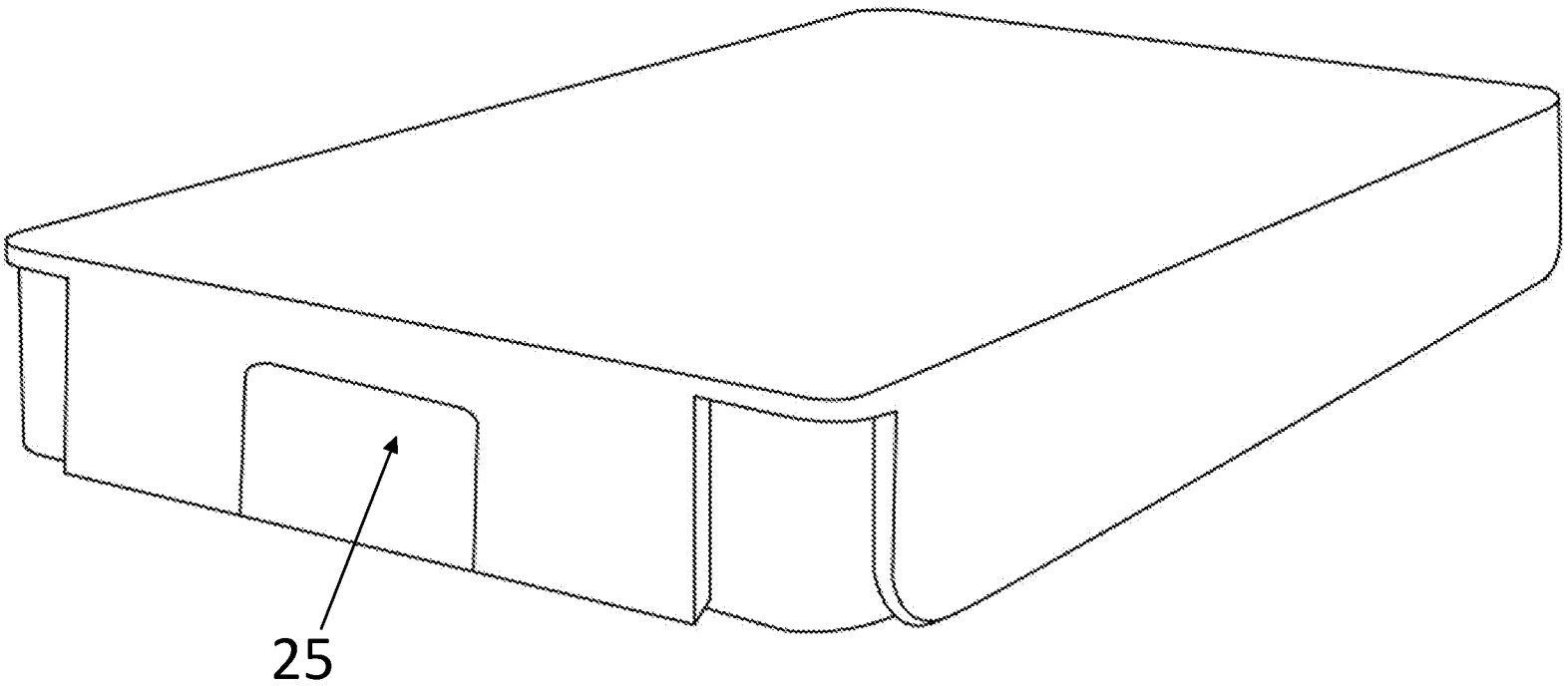

FIGS. 12 and 13 show schematically 3-dimensional views of a medical package in its closed state having a pair of opening elements 24 and 25 located on the shortest and opposite sides of the medical package according to some embodiments of the invention.

In this way a higher level of child safety is achieved as a child hand cannot simultaneously exert pressure on both opening elements located at a distance that is longer than the distance between the child thumb and one of the child four fingers when opened.

Figure 14:
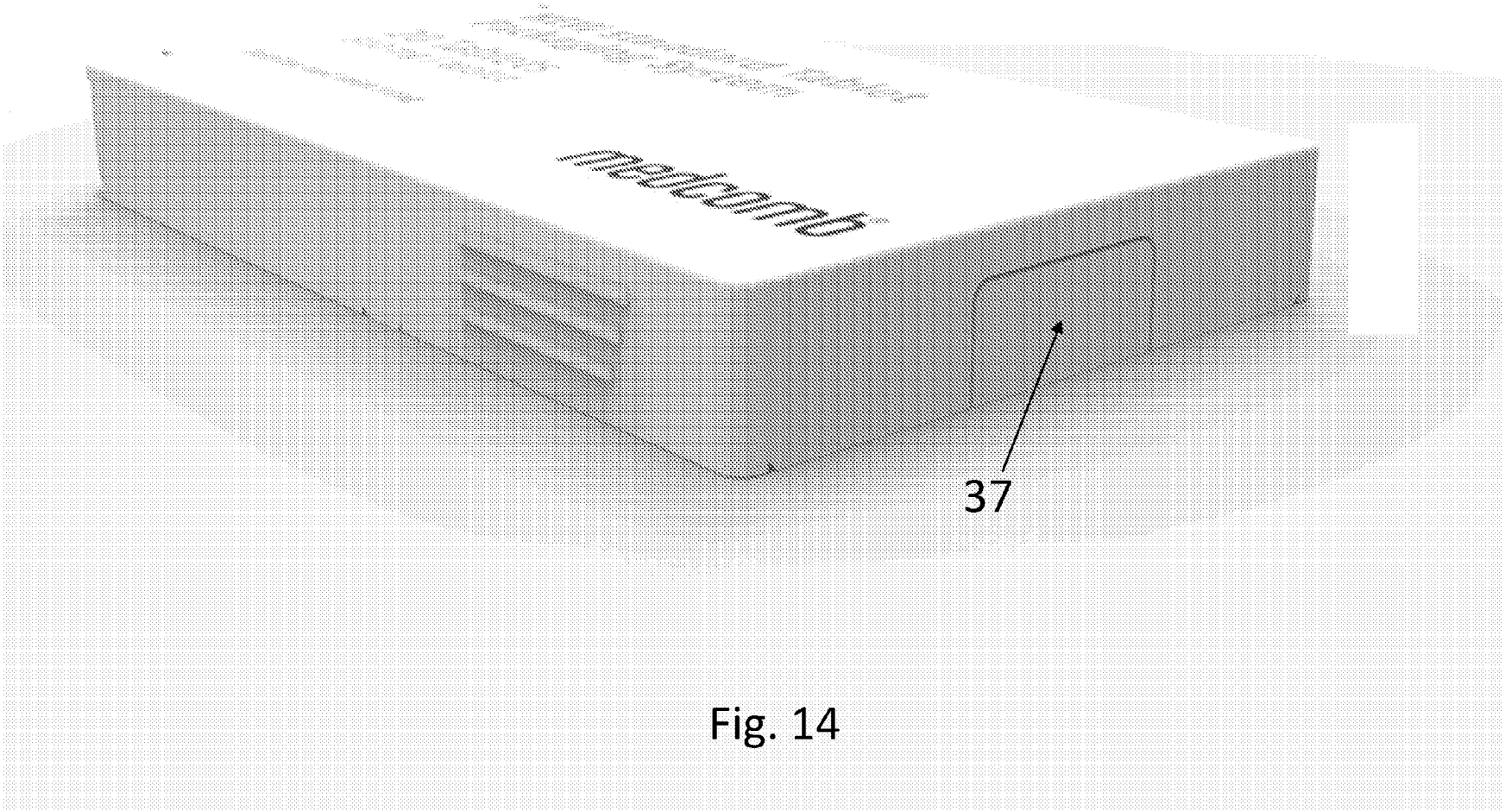
FIGS. 14, 15 and 16 show schematically 3-dimensional views of a medical package in its closed state where the correspondent two means for opening have different shapes according to some embodiments of the invention.
Figure 15:
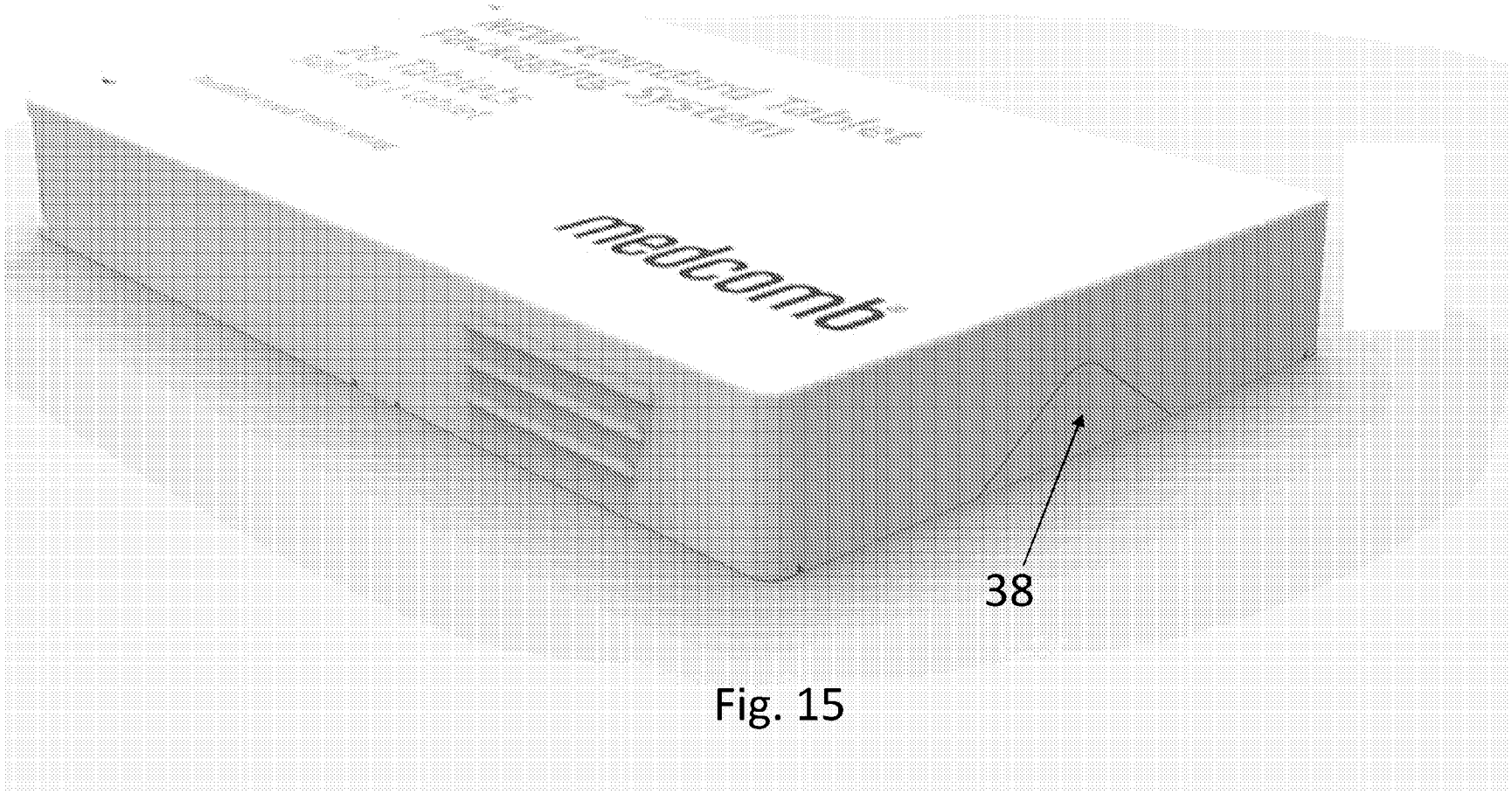
Figure 16:
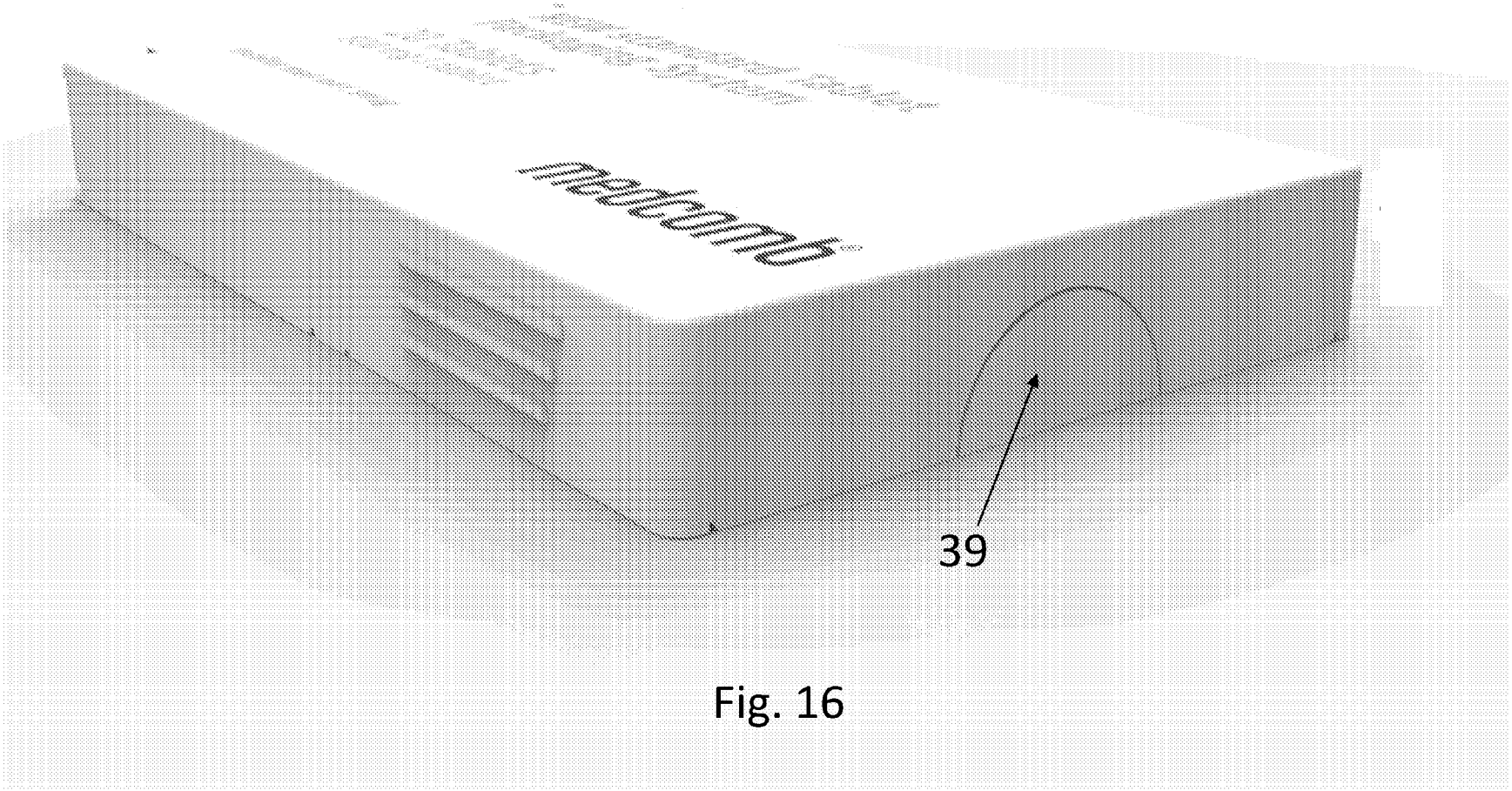

FIGS. 14, 15 and 16 show schematically 3-dimensional views of a medical package in its closed state where the correspondent pairs of opening elements 37, 38 and 39 have different shapes according to some embodiments of the invention.

The shapes may be misleading as counterintuitive towards the correct opening of the medical package.

Figure 17:
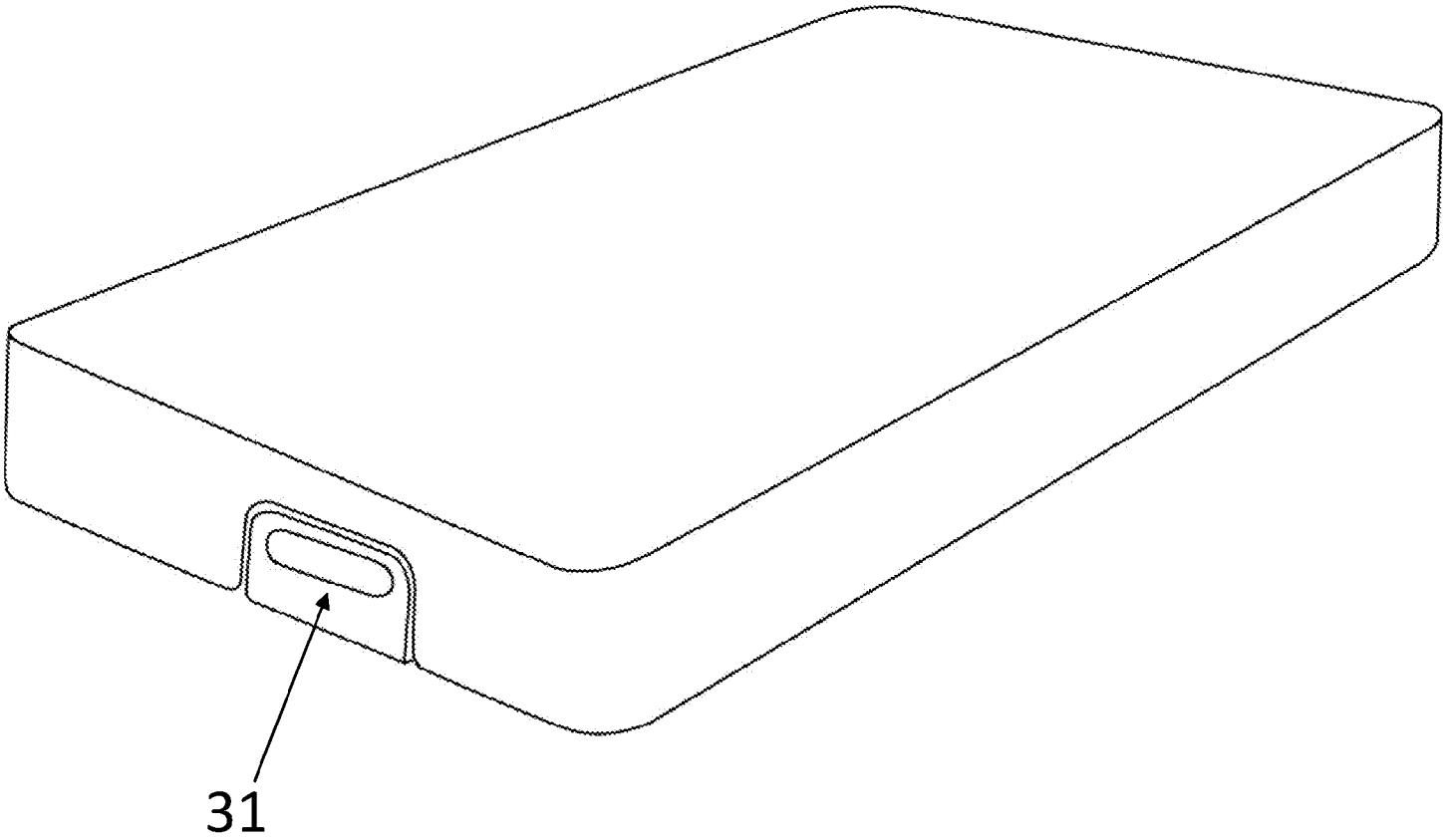
FIGS. 17 and 18 show schematically 3-dimensional views of a medical package in its closed state and half-opened state according to some embodiments of the invention.
Figure 18:
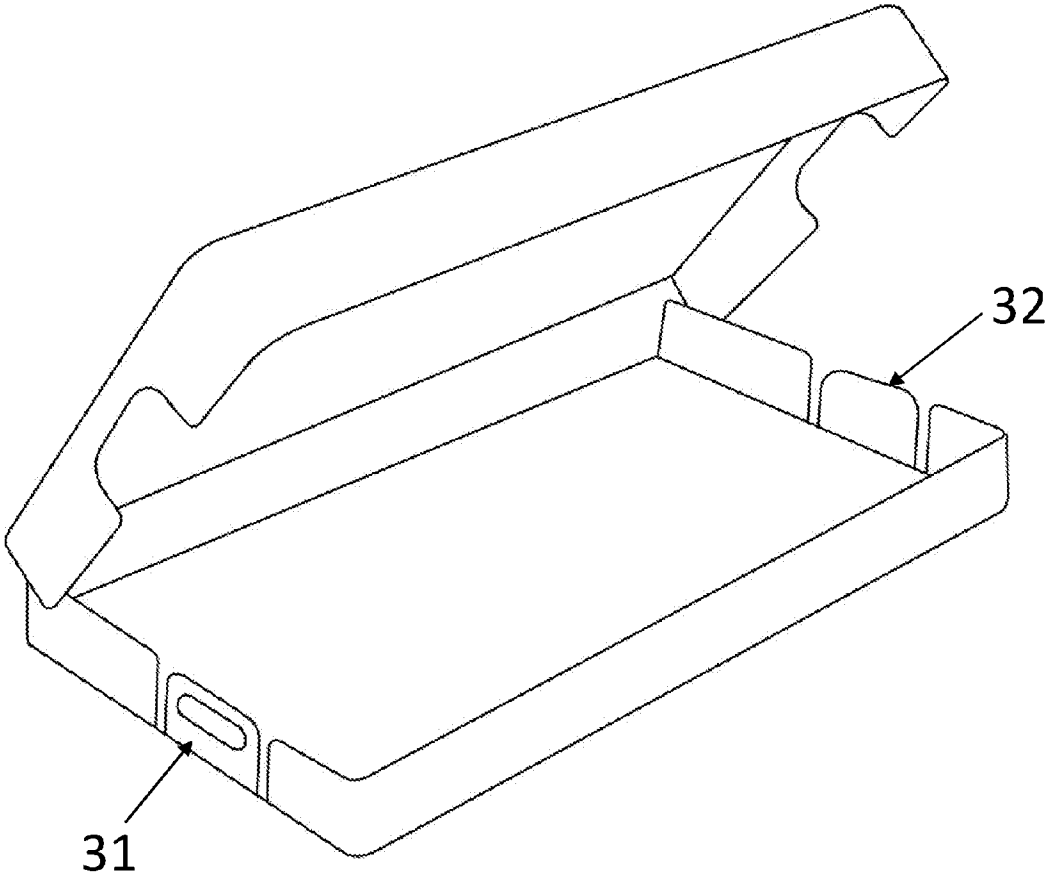

FIGS. 17 and 18 show schematically 3-dimensional views of a medical package in its closed state and while opening according to some embodiments of the invention.

Upon applying pressure on the opening elements 31 and 32 the medical package is unlocked and can be opened.

The medical package showed in FIG. 12-16 may follow the same opening steps as shown in FIG. 18.

Figure 19:
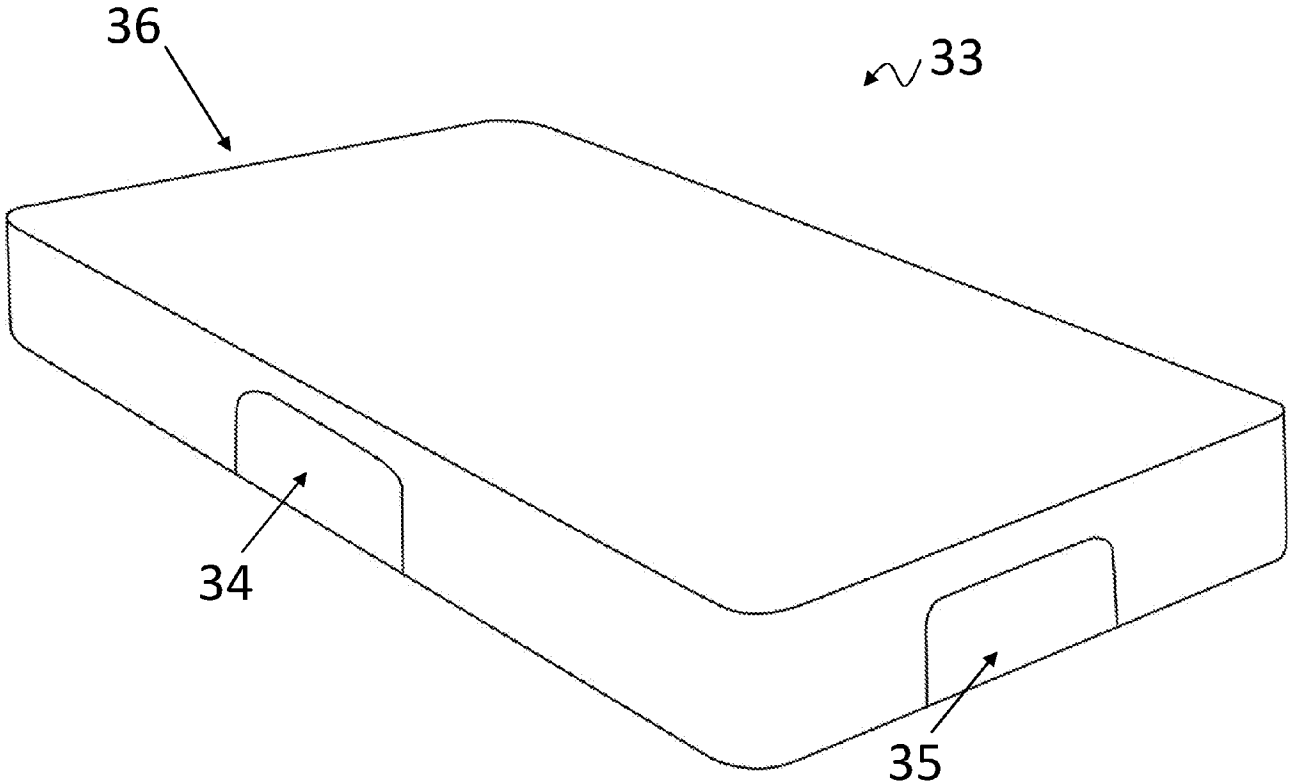
FIG. 19 show schematically a 3-dimensional view of a medical package having more than two means for opening according to some embodiments of the invention.

FIG. 19 show schematically a 3-dimensional view of a medical package having more than two means for opening according to some embodiments of the invention. For example the package 33 has three opening elements 34, 35 and 36.

In some embodiments two or more finger-actuated latches or tool-actuated latches may be released in a certain sequence so as to allow opening of the medical package. It may be that two or more sets of latches may have to be released in a certain sequence so as to allow opening, thus requiring two adult hands to actuate the two or more set of latches.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A medical package comprising:

a first portion for holding a carrier for a pharmaceutical composition or a medical device;

a second portion, wherein said first and second portion are adapted to mutually engage upon folding and/or pressing of said second portion and said first portion onto each other, said second portion when engaged onto said first portion producing a rigid structure having a bursting strength between 1 and 1000 pounds per square inch (psi) and a compressive strength between 1 and 1000 pounds per square inch (psi) thereby providing a child resistant medical package that cannot be crushed or perforated by child handling; and two pairs of gripping elements, wherein said two pairs of gripping elements have the same shape and, wherein only one of said two pairs of gripping elements comprises at least two openers or opening elements that physically hinder children from opening said medical package.

2. The medical package according to claim 1, wherein said first and second portion are made from a single sheet foldable into a folded configuration and, wherein said first and second portion are pivotally connected to each other.

3. The medical package according to claim 1, wherein said first and second portions are made from separate sheets, wherein said first and second portions are pivotally connected to each other.

4. The medical package according to claim 1, wherein said first and second portions comprise members which mutually engage upon folding and/or pressing of said first and said second portions onto each other.

5. The medical package according to claim 4, wherein said mutual engagement comprises interlocking between said members, wherein said mutual engagement comprises an interference fit between said members and, wherein said members are members located on external surfaces of said first and/or second portions.

6. The medical package according to claim 4, wherein said members are protrusions extending out of the external surface of said first portion and depressions on the external surface of said second portion.

7. The medical package according to claim 1, wherein said first and second portions have members having complementary shapes so that members on said first portion are adapted to engage in an interference fit with members on said second portion when said first and said second portions are folded onto each other.

8. The medical package according to claim 1, wherein at least said first portion has a rim, said rim protruding out of said first portion, said rim being located at least partially around an internal peripheral edge of said first portion thereby when folded said rim is press fit with at least part of a side wall of said second portion.

* * * * *